United States Patent [19]

Wood et al.

[11] Patent Number: 4,568,398

[45] Date of Patent: Feb. 4, 1986

[54] TITANIUM ALLOYS

[75] Inventors: John V. Wood, Bolnhurst; Bijan Toloui, Summertown both of England

[73] Assignee: National Research Development Corp., London, England

[21] Appl. No.: 716,586

[22] Filed: Mar. 27, 1985

[30] Foreign Application Priority Data

Apr. 6, 1984 [GB] United Kingdom ..... 8408975

[51] Int. Cl.[4] ..... C22C 14/00

[52] U.S. Cl. ..... 148/421; 164/900; 420/417

[58] Field of Search ..... 164/900; 148/2, 11.5 F, 148/11.5 R, 407, 421, 400; 420/417–421, 490

[56] References Cited

U.S. PATENT DOCUMENTS

| | | | |
|---|---|---|---|
| 3,840,364 | 10/1974 | Flemings et al. | 75/63 |
| 3,902,544 | 9/1975 | Flemings et al. | 164/71 |
| 3,936,298 | 2/1976 | Mehrabian et al. | 148/400 |
| 4,108,643 | 8/1978 | Flemings et al. | 148/400 |
| 4,415,374 | 11/1983 | Young et al. | 148/11.5 C |
| 4,494,461 | 1/1985 | Pryor et al. | 164/900 |
| 4,510,987 | 4/1985 | Collot | 164/900 |

*Primary Examiner*—Peter K. Skiff

*Attorney, Agent, or Firm*—Cushman, Darby & Cushman

[57] ABSTRACT

A solid titanium alloy comprises Ti+Co+Cu+ optionally other elements. The titanium is from 95 to 40 wt. %. The liquidus is below 1300° C. and the structure is of small equiaxed high-melting grains surrounded by at least 10 vol. % of low-melting material. This structure is achieved by vigorously agitating the alloy between its liquidus and solidus so as to break up dendrites, and thereby permits the alloy to be subsequently thixocast.

20 Claims, 4 Drawing Figures

TITANIUM ALLOYS

This invention relates to titanium alloys. More particularly, this invention relates to titanium alloys of particular morphology; to processes for their preparation; and to castings thereof. The alloys are of particular, but not exclusive, interest in the field of dental restorative materials: for example, they are also of interest in surgery, as in the fabrication of orthopaedic endoprostheses and surgical instruments; in jewellery; and in general engineering (such as aerospace and automotive) applications.

Alloys of gold are still, in the United Kingdom, the most widely used restorative materials employed in the manufacture of dental castings; for example, as in dental crown and bridge work. In North America and Australia alloys of base metals (for example, based on Ni-Cr or Co-Cr systems) have become adopted. However, these materials, by reason of the higher melting points of the alloys and their enhanced reactivity when molten, are more difficult to handle requiring more sophisticated, and therefore more expensive, equipment. Moreover, neither nickel nor cobalt alloys offer an exhaustive solution to the problem of increasing gold prices. Thus, it has been said that some 20% of the population of the USA is allergic to high-nickel alloys; also, doubts exist about the bioacceptibility of high-cobalt alloys; furthermore, the scarcity of cobalt is a further deterrent from its widespread adoption.

At present, dental castings are prepared by investing a mould with a molten alloy of gold in accordance with the "lost wax" technique. The requirements for any viable alternative casting system, or alloy, must include:

(i) minimum expenditure on new equipment;
(ii) existence of suitable mould materials both for the process and the alloy;
(iii) ease of producing complex or fine cast shapes;
(iv) a low amount of shrinkage during solidification;
(v) a bioacceptible alloy.

This invention seeks to provide such a casting system and alloy.

According, therefore, to one aspect of this invention, there is provided a solid titanium alloy comprising, other than impurities (if any):

(a) from 95 wt % to 40 wt % titanium; and
(b) at least one other metal which is a Group IB metal, a Group VIII metal, silicon, chromium or manganese, the total amount of (b) being correspondingly from 5 wt % to 60 wt %, the solid alloy having a homogeneous dispersion of discrete particles of at least one primary solid phase within a matrix of at least one, lower melting secondary solid phase.

When examined metallographically the alloys of this invention are found to have regular, usually small, equiaxed or even rounded grains of a primary solid phase surrounded by low melting material. Typically the or each primary phase is substantially free from interconnecting dendrites comprising instead discrete degenerate dendrites with little branched structure and approaching a spherical configuration, a characteristic which readily distinguishes them from conventional (that is, gravity cast) alloys of the same composition which are found to have a dendritic or cellular structure.

The groups referred to herein are those of the Periodic Table depicted in "Advanced Inorganic Chemistry" by Cotton & Wilkinson (Second Edition) published by Wiley Interscience.

The alloys of this invention may be binary, ternary, quaternary or even higher alloys, desirably binary or ternary alloys. From such alloys it is preferred to select those which exhibit a substantial difference in composition between tie-line (or tie-plane) related liquidus and solidus points as defined by equilibrium cooling (that is, those alloys which have an equilibrium (as defined by the ratio of solute in the solid to that in the liquid) or effective partition coefficient less than one, preferably below 0.7, for example below 0.5) and/or a substantial liquidus-solidus gap (that is, a wide range of temperature over which a solid and liquid slurry exists under equilibrium and non-equilibrium conditions). The former facilitates selection of a composition which will provide an appropriate volume fraction of slurry; the latter gives greater process tolerance. It is also highly desirable, from considerations of refractory integrity and economy of heat investment, to select those alloys of a composition which exhibits a liquidus, at standard pressure, below 1400° C., preferably below 1300° C., especially below 1200° C.: for example 11OO° C. or less. From such alloys those which exhibit at least 10 vol % of liquid fraction at a temperature below 1300° C. are preferred.

Examples of such alloying elements include Ag, Au, Co, Cr, Cu, Fe, Mn, Ni, Pd or Pt with Ag, Au, Co, Cu, Ni, Pd or Pt being preferred for use in dental restorative materials and orthopaedic endoprostheses, although Fe, Mn and Ni provide non-dental structural alloys which have good processing properties; for example, in subsequent thixocasting. Cr, and also V, Sn and Al, satisfy the liquidus criterion mentioned above only as a component in ternary or higher alloys; Si, Ge, Nb, Mg, Zr, Mo and Gd may also be incorporated in ternary or higher alloys in amounts typically not exceeding 11 wt %. Up to 6 wt % Nb may be added and, to combat the thus-caused temperature rise, up to 4 wt % Al (additional to the 100 wt % of Ti, Ti-Co, Ti-Cu or Ti-Co-Cu).

For binary alloys, with the exceptions, discussed below, of Ti-Ag and Ti-Au, it is found that very satisfactory processing is accomplished when (b) comprises from 10 wt % to 40 wt %, preferably from 15 wt % to 30 wt % such as up to 25 wt %. The precise values of the limits depend upon the particular binary system; thus: Ti-Co 10 wt % to 23 wt %, preferably 12 wt % to 20 wt %; Ti-Cu 10 wt % to 40 wt %, preferably 15 wt % to 30 wt %; Ti-Fe 10 wt % to 30 wt %, preferably 15 wt % to 25 wt %; Ti-Mn 20 wt % to 40 wt %, preferably 25 wt % to 35 wt %; Ti-Ni 10 wt % to 25 wt %, preferably 15 wt % to 20 wt %; Ti-Pd and Ti-Pt 27 wt % to 45 wt %, preferably 30 wt % to 40 wt %. With Ti-Ag the respective limits are 15 wt % to 60 wt %, preferably from 20 wt % to 40 wt %; with Ti-Au from 45 wt % to 50 wt %.

For ternary or higher alloys it is generally found appropriate to include no more of any one component (b) than is indicated for a binary alloy; and to have a maximum solute content of 50 wt %, preferably up to 30 wt %, especially up to 25 wt %.

Particularly preferred systems which have been investigated as possible dental restorative materials are the Ti-Ag, Ti-Co, Ti-Cu, Ti-Co-Cu, Ti-Cu-Ag and Ti-Co-Cu-Ag systems. Examples include Ti-Ag with from 20 wt % to 30 wt % Ag; Ti-Cu with 10 wt % to 20 wt % Cu; Ti-Co with 12 wt % to 20 wt % Co; Ti-Cu-Ag with 15 wt % to 40 wt % and Ti-Co-Cu with 10 wt % to 25 wt % solute. The last mentioned ternary system comprises, especially within 10 wt % to 15 wt % solute limits, a large field of alloys which have a solidus, and can thus be processed in accordance with this invention, below 1100° C. The optimum proportion of Cu when present is 10–15 wt %. The weight ratio of Co:Cu is suitably from 0.5 to 2.0, for example 1.0. The analogous quaternary system with 0.5 to 5.0 wt % Ag has been found to possess very desirable processing characteristics.

Small amounts (typically from 0.001 to 0.2 wt %) of Pd are very beneficial in preventing corrosion.

Examples of such alloys of the invention, with some of their properties are shown in the tables below:

TABLE I

| Composition wt % | Binary Titanium Alloys DTA results Solidus Temperature | Hardness ($H_v$) |
|---|---|---|
| Cu 23–27 | 990 | 280–320 |
| Co 18–22 | 1020 | 480–510 |
| Ag 45–60 | 1030 | 540–680 |

TABLE II

| Ternary Ti—Co—Cu Alloys | | | | | | | | |
|---|---|---|---|---|---|---|---|---|
| Composition | | DTA results | | Hardness ($H_v$) | | Primary phase composition | | |
| Co wt % | Cu wt % | Solidus temp | Eutectoid temp | Primary phase | (Eutectic or peritectic) | Ti | Co | Cu |
| 14.5 | 7.5 | 1060 | 690 | 460–550 | 480–550 | 89 | 8 | 3 |
| 13 | 10 | 970 | 705 | 530–540 | 560–570 | 89 | 7 | 4 |
| 11.5 | 12.5 | 960 | 730 | 480–550 | 580–610 | 88 | 7 | 5 |
| 10 | 15 | 970 | 720 | 520–560 | 500–530 | 90 | 5 | 5 |

This invention further provides a process for preparing a solid titanium alloy of the invention, which process comprises heating the titanium alloy to produce an alloy mixture which is part liquid and part solid; vigorously agitating the entire alloy mixture to create shear strain therein and a more equilibrium heat and mass distribution throughout the change as a result of enhanced mass and heat transfer; and solidifying the alloy mixture.

The solid titanium alloy may be heated, for example in an electric resistance or RF induction furnace, above the liquidus so that the entire mass of alloy is in the melt and then cooled until partial freezing occurs; or if a loose or compacted elemental or prealloyed powder compact is heated until enough of the alloy or mixture is in the liquid state to permit vigorous agitation, the latter being preferred for reasons of refractory integrity, economy of heat investment and also greater purity of the resulting solid alloy. Thereafter, the temperature of the alloy mixture is controlled to provide the required proportion of primary solid phase. As mentioned earlier, this is desirably below 1300° C., suitably below 1200° C. and may, with certain alloy compositions be below 1100° C.

By "primary solid phase" is meant herein the or each phase solidified to form degenerate dendrites (which are characterised by a smoother, less branched morphology which approaches a spherical configuration) suspended in the remaining liquid matrix during the process of the invention, which matrix becomes the secondary solid phase on complete solidification. The average size of the primary solid phase may vary widely: it may be as little as 1 micron or as coarse-grained as 10,000 microns. In a typical alloy sample, the size may range from 10 to 1000 microns. Where the alloy mixture is cooled from the melt, or from the semi-solid powder slurry, the size of the primary solid phase depends upon the time in the semi-solid state and inversely on both the cooling and the shear rates. By the process of this invention the proportion of primary solid phase produced may be high; for example, form 30 wt % to 60 wt % or even higher: for example, up to 70 wt %.

By "vigorous agitation" is meant herein agitation which is sufficient to prevent the formation of interconnected dendritic networks and/or substantially to eliminate or reduce any dendritic branches already formed in the primary solid phase. The vigorous agitation may be effected by at least one driven stirrer inserted into the alloy mixture. The or each stirrer may be formed in several configurations: for example, as a rotating blade (as in U.S. Pat. No. 3,840,364) or screw or splined auger (as in U.S. Pat. No. 3,902,544), provided only that they are operable to create shear in the alloy mixture. The or each stirrer may be driven, for example, by a variable speed electric motor assembly, at an angular speed of from 1000 to 30 rpm; for example, from 150 to 50 rpm such as about 100 rpm. The vigorous agitation may be maintained for a period typically from 3 to 30 minutes, although it is preferred to agitate for as short a time as is possible: from 5 to 15 minutes is, in general, a satisfactory agitation time.

However, the presence of an internal stirrer is found to entrain voids, oxides and other impurities into the cast ingot. Moreover, the ingot from a batch process prepared in the presence of an internal stirrer is typically paraboloidal or irregular in shape and difficult further to process. In accordance, therefore, with a preferred aspect of this invention there is provided a modification to the aforementioned process of the invention by which it is possible to dispense with internal stirring. This modification to the process comprises imparting to a mould containing the alloy mixture angular velocity sufficient vigorously to agitate the entire alloy mixture to create shear strain therein.

The angular velocity may be continuously of the same magnitude and/or sense; preferably, however, the sense varies periodically to provide a reciprocating motion and corresponding reciprocating shear in the entire alloy mixture. Neither the magnitude nor the duration of the angular velocity in a given sense need by the same as that in the opposite sense.

In accordance with a preferred feature of this invention, the solid titanium alloys of this invention may be prepared in accordance with the process disclosed in copending U.S. patent application Ser. No. 716,587, filed on Mar. 27, 1985.

By utilising this embodiment of the process of this invention it is possible to ensure that the solid titanium alloy comprises from 75 wt % to 90 wt % of primary solid phase.

The process of the present invention may be effected continuously.

In accordance with a further embodiment of this invention, the alloy so formed is thixocast; this may be as hereinafter described for example into a mould cavity which is rammed towards a stationary support for the alloy.

This invention provides a solid titanium alloy produced or cast by a process of the invention.

This invention further provides a solid titanium alloy of the invention formed as a dental restoration or as an orthopaedic endoprosthesis or as a surgical instrument.

The invention will be further described, by way of example, with reference to the accompanying drawings, in which.

Figure 1:
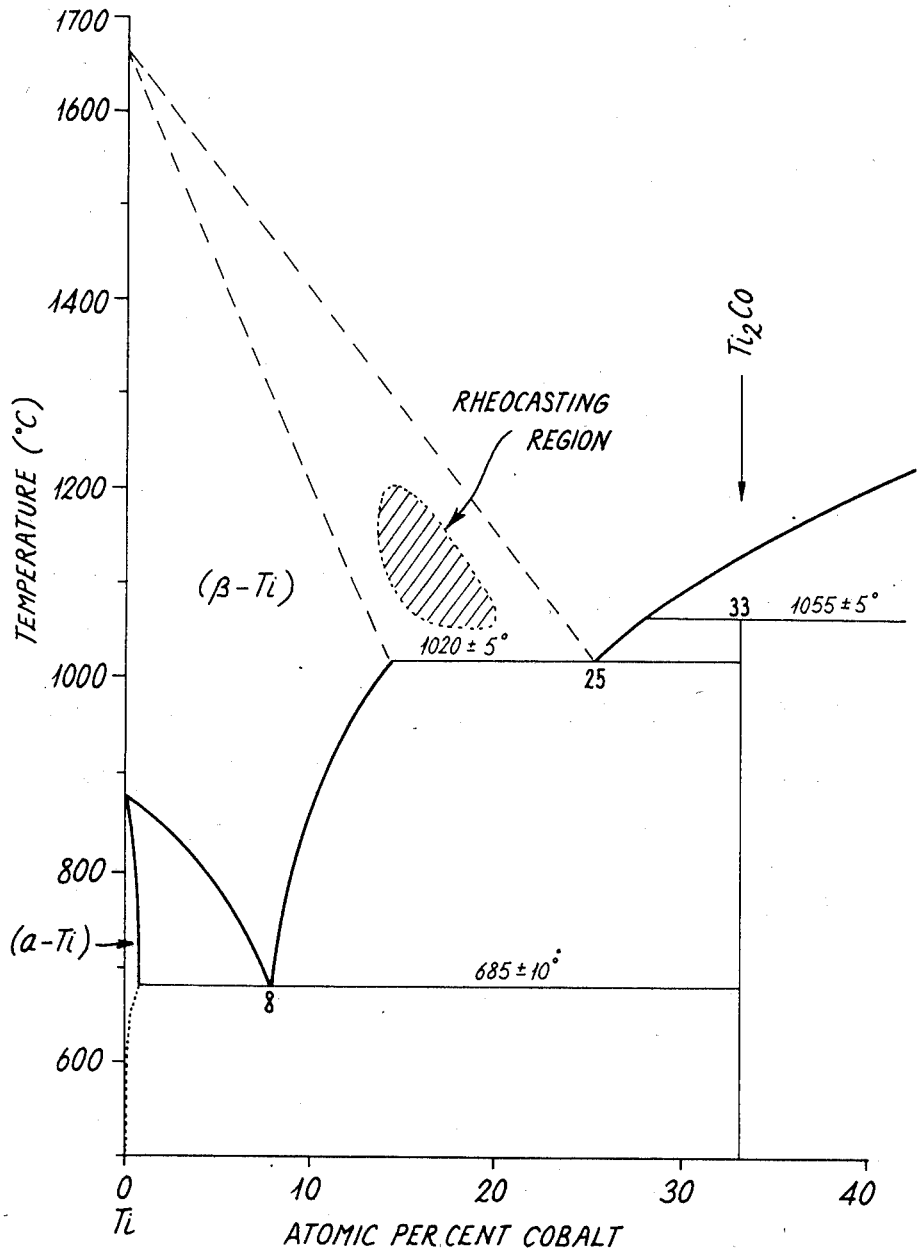
FIG. 1 represents the titanium-rich portion of the Ti-Co binary phase diagram with the optimum region for preparing solid titanium alloys of the invention shown hatched.

In the drawings, the reciprocating shear rheocasting apparatus comprises a crucible 1 of graphite or refractory oxide, nitride or carbide; for example of $Al_2O_3$, $ZrO_2$, $SiO_2$, $SiN_4$ or TiC, preferably phosphate-bonded silica, having an internal diameter of 20 mm. This is axially connected from below to a stepping motor (not shown) controlled by a microprocessor. Specifically, the stepping motor is a mini-angle stepper driven by a drive card which, in turn, is controlled by a dedicated computer. Both speed (constant or variable) and direction (clockwise or counter-clockwise) are parameters precisely controllable by this microprocessor arrangement to provide an oscillation range from 0.01 Hz to 20 Hz through an angular range from 1.8° to 50°. The crucible is surrounded by a coaxially-wound, relatively moveable RF heating coil 2. The apparatus is enclosed in an evacuatable, transparent quartz shroud (not shown) which has entry and exit ports for a vacuum/dry argon line.

Figure 2:
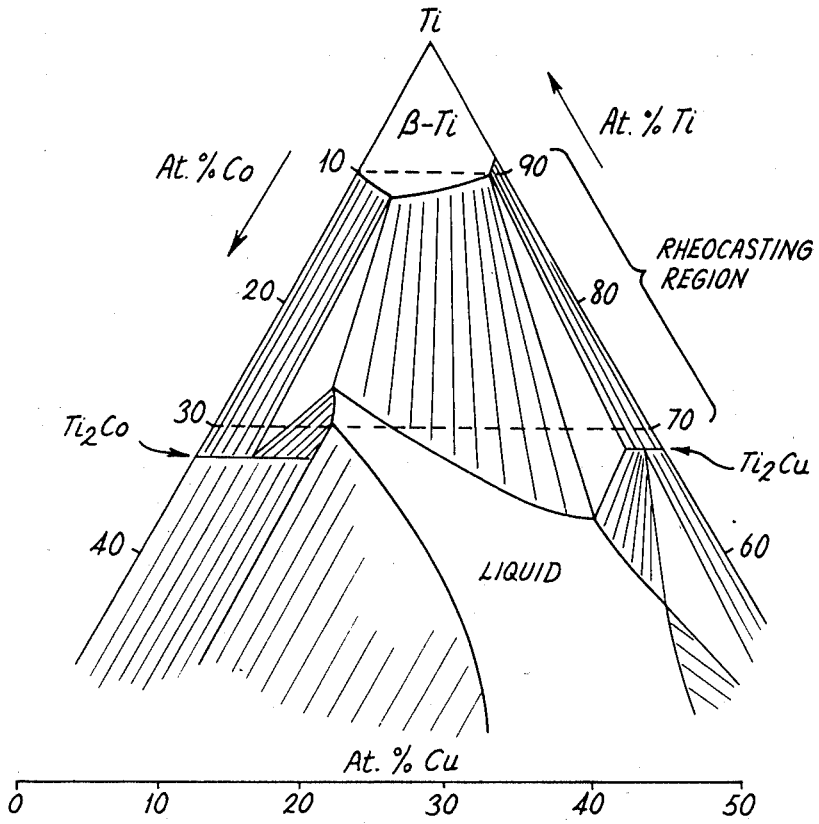
FIG. 2 represents the titanium-rich corner of the Ti-Co-Cu ternary phase diagram with the optimum region for preparing solid titanium alloys of the invention shown delineated.
Figure 3:
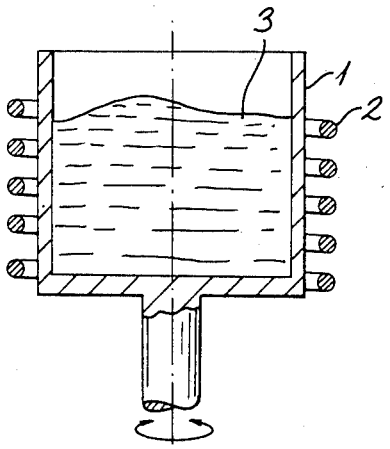
FIG. 3 represents a schematic axial cross-section of the reciprocating shear rheocasting apparatus used in the present invention.
Figure 4:
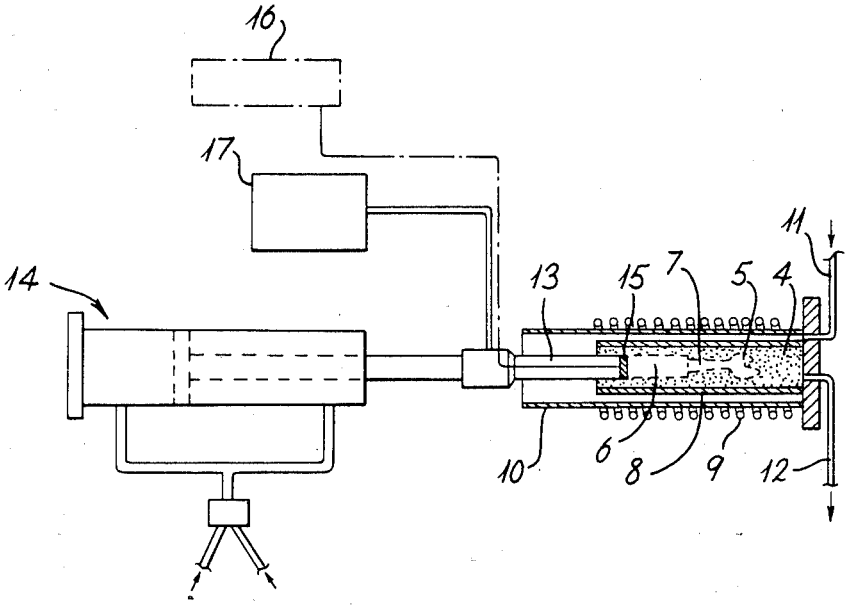
FIG. 4 represents a schematic view, partially axially cross-sectioned, of the thixocaster used in the present invention.

In use in accordance with the present invention, a coarsely ball-milled charge 3 of a preformed solid titanium alloy, suitably of a composition indicated in FIGS. 1 or 2, or conventional (e.g. gravity-cast) morphology is fed into the crucible. The apparatus is evacuated to about $10^{-5}$ Torr and dry argon is then admitted to 500 Torr. The RF heating coil is energised and when the alloy is completely melted (typically after 3 to 5 minutes whereupon the temperature of the alloy is about 1400° C.) it is Permitted to cool to a lower temperature at which the alloy mixture will have the required primary solid phase composition. The stepping motor is then activated to provide, for approximately 5 to 20 minutes, a reciprocating shear action at 1 Hz with an angular range of 20°. Thereafter the heating coil is switched off the alloy permitted to solidify while the agitation is continued. When the solid titanium alloy of the invention so produced has reached ambient temperature the crucible is removed from the apparatus and the ingot broken free.

In the drawings, the thixocaster comprises a horizontally-aligned, axially-fed cylindrical mould 4 comprising a mould cavity 5 communicating with an axial shot chamber 6 formed within a ceramic investment 7. The investment is surrounded by a carbon susceptor sleeve 8 for an RF heating coil 9 which is coaxially wound about a quartz shroud 10 having entry and exit ports 11 and 12 for a vacuum/dry argon line. A piston 13 co-operates with the shot chamber and is driven by a pneumatic or hydraulic activator system indicated generally at 14. The ram face 15 of the piston is equipped with a thermocouple 16 and strain gauge transducer 17.

In use in accordance with this invention, a slug of the solid titanium alloy of the invention, weighing about 20 grams, is inserted into the shot chamber. The thixocaster is evacuated to about $10^{-5}$ Torr and dry argon is then admitted to 500 Torr or as a continuous argon gas flow. The RF heating coil is energised with the ram face of the piston seated against the slug and when the temperature and softness of the slug are determined to be appropriate the piston is actuated and the alloy is rammed into the mould cavity. Alternatively, the alloy slug may be compressed between a stationary ceramic support and a ceramic mould cavity advanced by the ram. Thereafter the heating coil is switched off and the alloy permitted completely to solidify to form the casting.

The rheocasting process of this invention may be effected continuously.

We claim:

1. A solid titanium alloy comprising, other than impurities (if any):

(a) from 95 wt % to 40 wt % titanium; and (b) at least one other metal which is a Group IB metal, a Group VIII metal, silicon, chromium or manganese, the total amount of (b) being correspondingly from 5 wt % to 60 wt %, the solid alloy having a homogeneous dispersion of discrete particles of at least one primary solid phase within a matrix of at least one, lower melting secondary solid phase.

2. A solid titanium alloy according to claim 1 which has at least one primary solid phase substantially free from interconnecting dendrites.

3. A solid titanium alloy according to claim 1 which is one of a binary, ternary and quaternary alloy.

4. A solid titanium alloy according to claim 1 which exhibits a liquidus, at standard pressure, below 1400° C.

5. A solid titanium alloy according to claim 4 which exhibits a liquidus, at standard pressure, below 1300° C.

6. A solid titanium alloy according to claim 1 which exhibits at least 10 vol % of liquid fraction at a temperature below 1300° C.

7. A solid titanium alloy according to claim 1 wherein (b) comprises at least one of Ag, Au, Co, Cr, Cu, Fe, Mn, Ni, Pd or Pt.

8. A solid titanium alloy according to claim 7 wherein (b) comprises at least one of Ag, Au, Co, Cu, Ni, Pd or Pt.

9. A solid titanium alloy according to claim 1 wherein (b) comprises from 10 wt % to 40 wt %.

10. A solid titanium alloy according to claim 1 which is a Ti-Co; Ti-Cu, Ti-Co-Cu; Ti-Cu-Ag or Ti-Co-Cu-Ag alloy.

11. A solid titanium alloy according to claim 9 wherein (b) comprises up to 25 wt %.

12. A solid titanium alloy according to claim 1 which exhibits a solidus below 1100° C.

13. A process for making a solid titanium alloy according to claim 1 which process comprises heating the titanium alloy to produce an alloy mixture which is part liquid and part solid; vigorously agitating the entire alloy mixture to create shear strain therein; and solidifying the alloy mixture.

14. A process according to claim 13 wherein the titanium alloy is not heated above the liquidus temperature.

15. A process according to claim 14 wherein the titanium alloy is not heated above 1100° C.

16. A process according to claim 13 wherein a mould containing the alloy mixture is given an angular velocity sufficient vigorously to agitate the entire alloy mixture to create shear strain therein.

17. A process according to claim 13 wherein the solid titanium alloy comprises from 40 wt % to 65 wt % of primary solid phase.

18. A process according to claim 13 wherein the solid titanium alloy comprises from 75 wt % to 90 wt % of primary solid phase.

19. A process according to claim 13 wherein the alloy so formed is subsequently thixocast.

20. A process according to claim 19, wherein the alloy is thixocast into a mould cavity which is rammed towards a stationary support for the alloy.

* * * * *